US005755513A

United States Patent [19]

To

[11] Patent Number: 5,755,513

[45] Date of Patent: May 26, 1998

[54] RING BINDER

[75] Inventor: Chun Yuen To, Shatin, Hong Kong

[73] Assignee: World Wide Stationary Manufacturing Company Limited, Kwai Chung, Hong Kong

[21] Appl. No.: 707,397

[22] Filed: Sep. 4, 1996

[30] Foreign Application Priority Data

Sep. 4, 1995 [GB] United Kingdom ..... 9517993

[51] Int. Cl.[6] ..... B42F 3/04

[52] U.S. Cl. ..... 402/36; 402/26; 402/70; 402/73

[58] Field of Search ..... 402/26, 36–42, 402/70, 73, 75, 80 R, 502; D19/27, 32

[56] References Cited

U.S. PATENT DOCUMENTS 3,175,847 3/1965 McKowen .
4,295,747 10/1981 Errichiello .
4,722,628 2/1988 Rager .
5,100,253 3/1992 Cooper .
5,160,209 11/1992 Schuessler .
5,269,616 12/1993 O'Neill .
5,476,335 12/1995 Whaley .

*Primary Examiner*—Frances Han
*Attorney, Agent, or Firm*—Pollock, Vande Sande & Priddy

[57] ABSTRACT

A ring binder is disclosed as being adapted to be secured to a cover by at least one rivet, the ring binder comprising a substantially rigid curved upper plate supporting a pair of pivotable elongate plates to which a plurality of ring members are mounted, and the rivet is engageable directly with the cover and the curved upper plate, and the rivet includes a cylindrical body with an inwardly bent upper end.

14 Claims, 5 Drawing Sheets

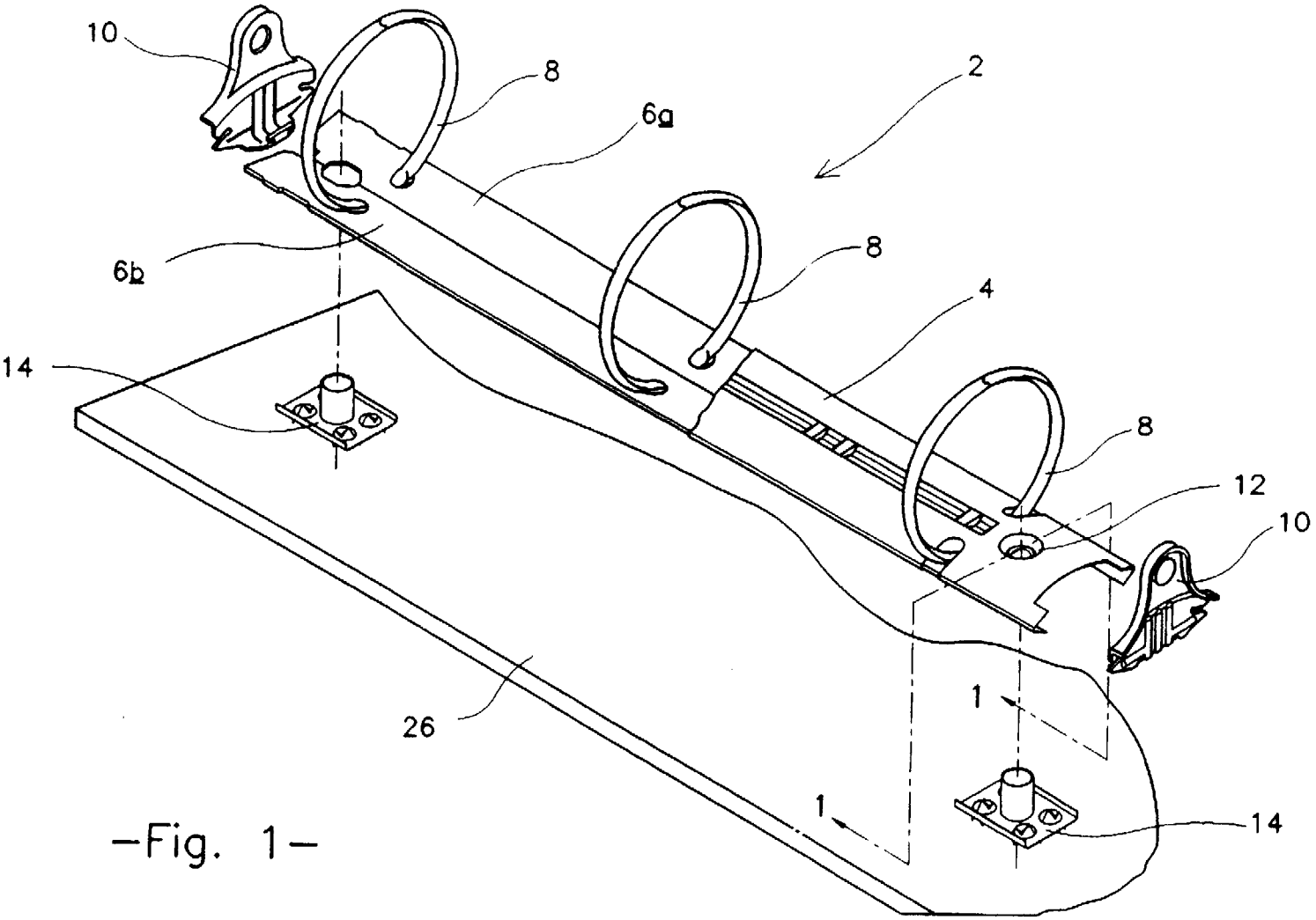
—Fig. 1—

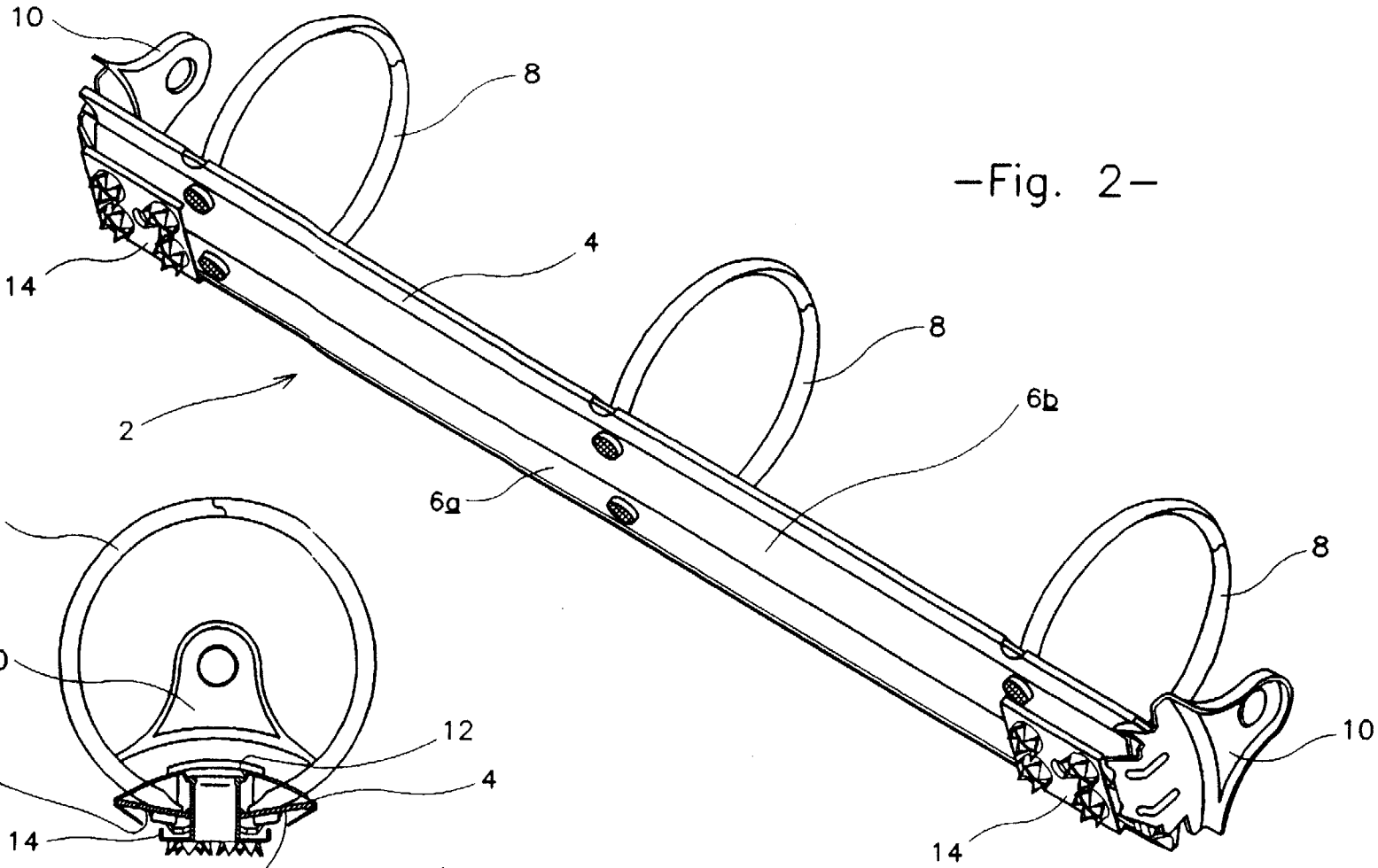
—Fig. 2—
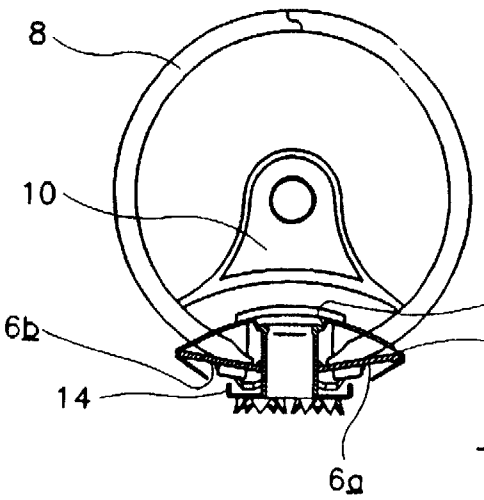
—Fig. 3—

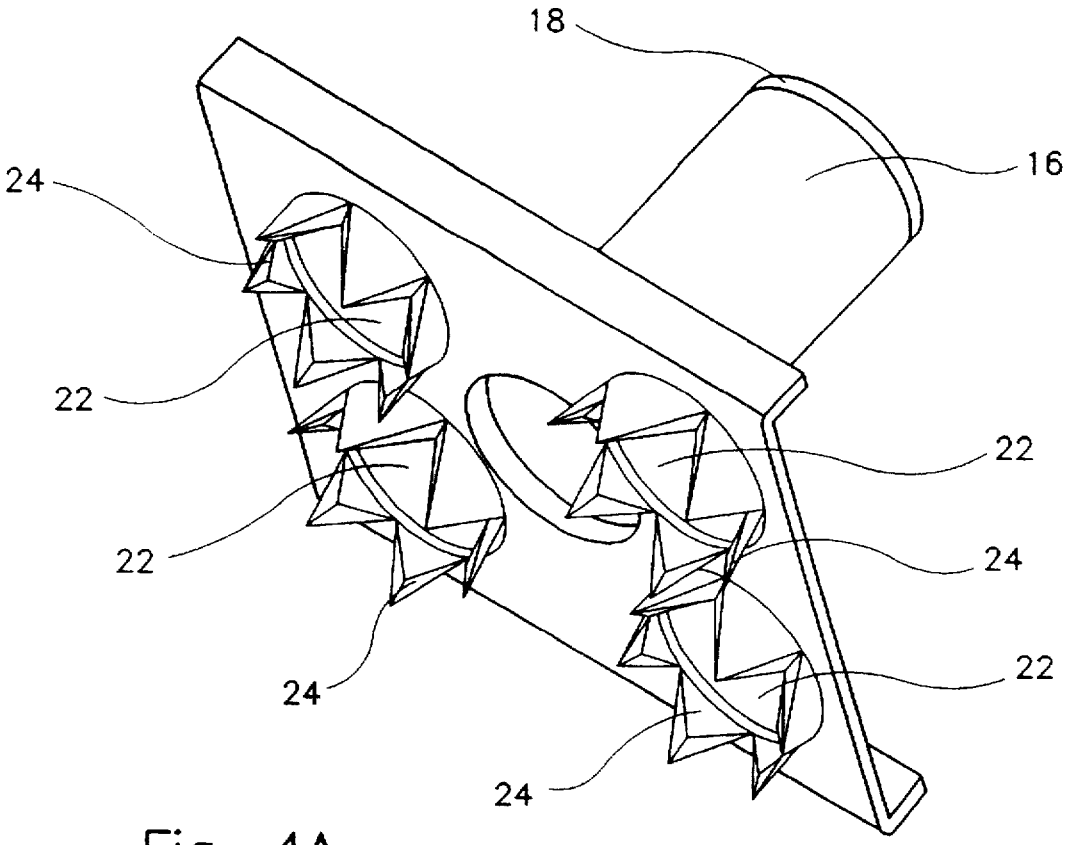
-Fig. 4A-
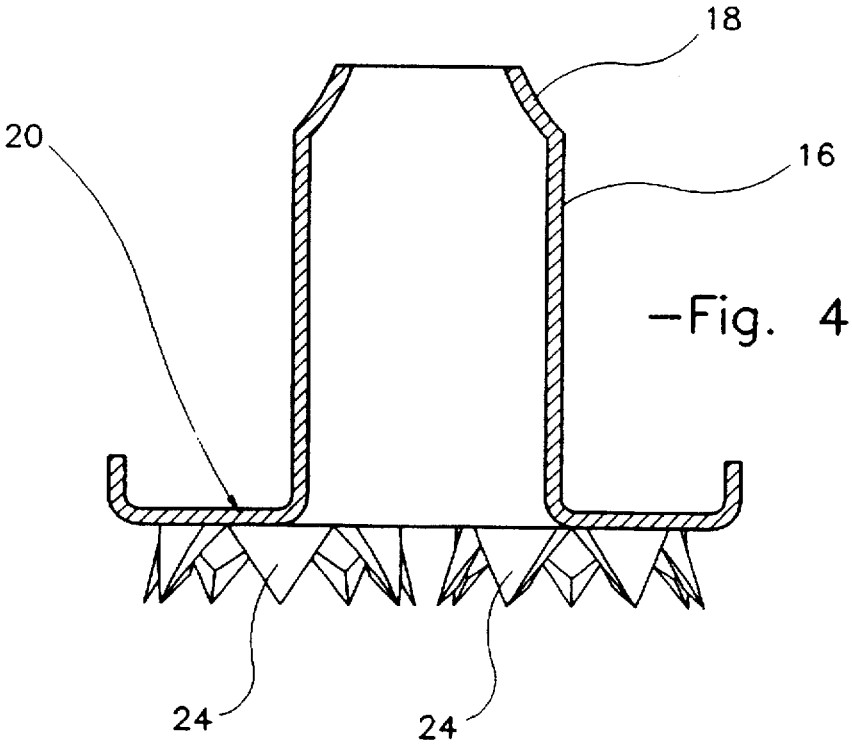
-Fig. 4B-

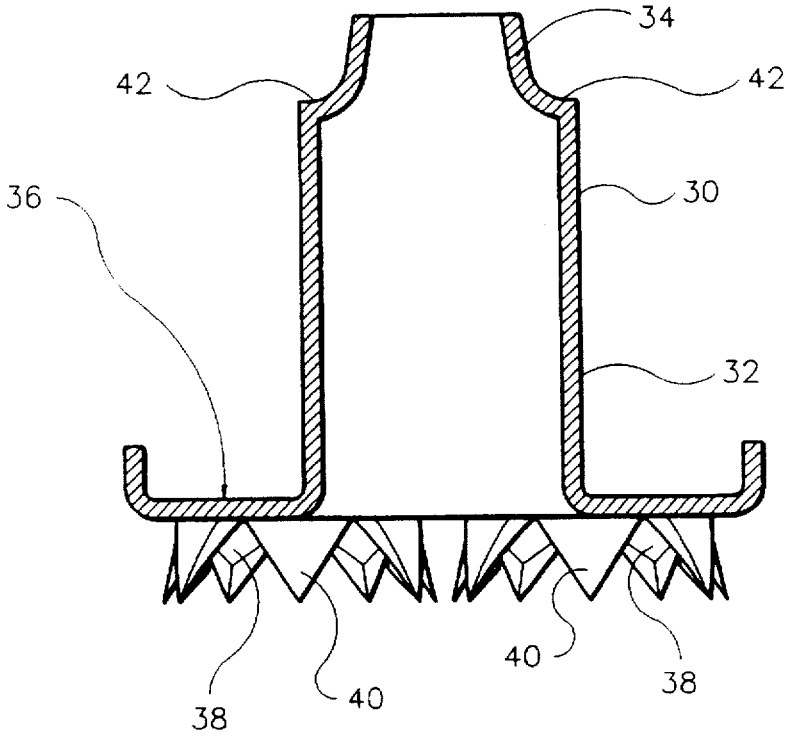
– FIG. 5 –
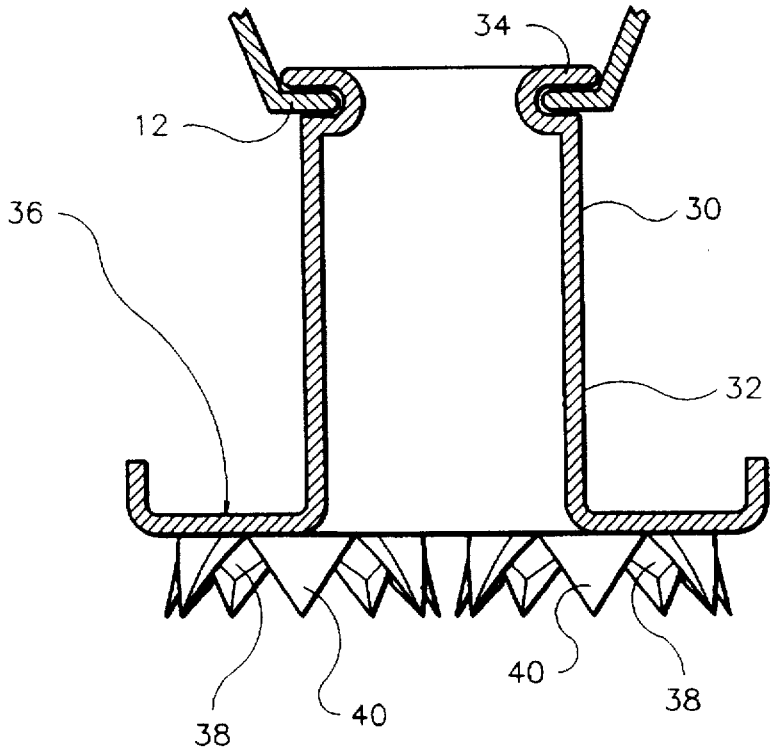
– FIG. 6 –

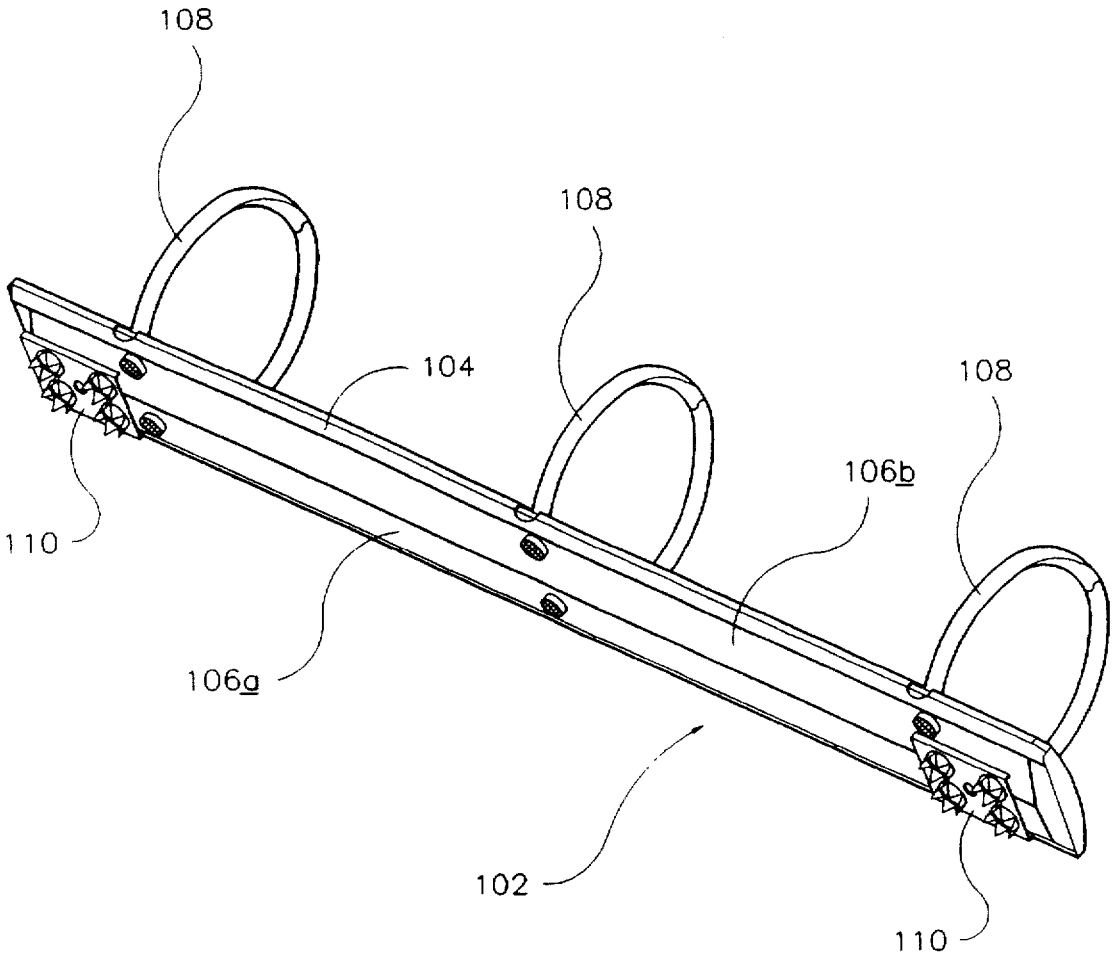
– FIG. 7 –

RING BINDER

This invention relates to a ring binder and, in particular, a ring binder adapted to be secured by at least one rivet to a base member.

Conventionally, a ring binder is securable to a cover by rivets having a head portion engageable with the cover and a tail portion which is deformable, e.g. by punching, to engage a barrel secured to an upper plate of the ring binder.

A disadvantage associated with such a conventional ring binder is that the assembling process is both laborious and prone to error. In the first place, it is necessary to provide the assemblers with rivets properly sized and shaped to fit both the barrels and the corresponding holes in the cover. The assemblers have to secure the ring binder to the cover by first inserting the rivet through the cover, then through the barrel in the ring binder and then to deform the tail of the rivet, e.g. by punching, to engage the upper plate of the ring binder.

It is therefore an object of the present invention to provide a ring binder in which the aforesaid shortcomings are mitigated.

According to the present invention, there is provided a ring binder adapted to be secured to a base member by at least one securing means, the ring binder comprising a substantially rigid upper structure supporting a pivotable lower structure to which a plurality of ring members are mounted, wherein the securing means is engageable directly with the base member and the upper structure, characterized in that the securing means includes a post member with an inwardly bent upper end.

Advantageously, said upper end may be deformable to engage the upper structure.

Conveniently, said post member may be substantially upstanding.

Suitably, the upper structure may comprise a recess with which said upper end is deformable to engage.

Said upper end may advantageously comprise a ledge member for receiving at least part of underside surface of the recess.

The securing means may conveniently comprise at least one securing member adapted to engage the base member.

The post member may suitably be integrally formed with the securing member.

Advantageously, the securing member may comprise a plurality of securing elements each deformable to engage the base member.

Conveniently, the securing element may be substantially downwardly pointing.

Suitably, the securing element may comprise an arcuate sector.

The plurality of securing elements may advantageously depend downward from the periphery of an aperture on a plate member of the securing means.

The plate member may conveniently be adapted to abut against the base member.

The invention will now be described by way of examples only and with reference to the accompanying drawings in which:

FIG. 1 shows an exploded view of a first embodiment of a ring binder according to the present invention with a cover;

FIG. 2 shows an underside perspective view of the ring binder shown in FIG. 1;

FIG. 3 shows a cross-sectional view of the ring binder along the line 1—1 in FIG. 1;

FIG. 4A shows an underside perspective view of the rivet shown in FIGS. 1 to 3;

FIG. 4B shows a cross-sectional view of the rivet shown in FIGS. 1 to 4A;

FIG. 5 shows a further type of rivet suitable for use in the present invention;

FIG. 6 shows the rivet shown in FIG. 5 engaged with the upper structure of the ring binder; and FIG. 7 shows a second embodiment of a ring binder according to the present invention.

FIGS. 1, 2 and 3 show a first embodiment of a ring binder according to the present invention, generally designated as 2, as comprising a substantially rigid curved upper plate 4 supporting a pair of elongate plates 6*a* and 6*b* pivotally moveable relative to each other. Secured to the elongate plates 6*a* and 6*b* are three ring members 8. At each end of the ring binder 2 is a lever 10 which may be pressed outward, e.g. by a thumb, to act upon the underside of the elongate plates 6*a* and 6*b* and thereby to open the ring members 8 in the conventional manner. Engageable with an open depression 12 near each end of the curved upper plate 4 is a rivet 14.

As shown more clearly in FIGS. 4A and 4B, the rivet 14 comprises a cylindrical body 16 having a narrower inwardly bent head 18 which is deformable, e.g. by punching, to engage the depression 12. The rivet 14 has a substantially flat plate 20 having four holes 22. Depending from the periphery of each hole 22 are a set of claws 24 which may be deformed, e.g. by pressing, to engage a cardboard or plastic (e.g. PVC) cover 26. The claws 24 are pushed out from the substantially flat plate 20. The body 16, head 18, substantially flat plate 20 and claws 24 are all integrally formed, so as to enhance the strength of the rivet 14.

The head 18 of the rivet 14 assists in locating the upper plate 4 relative to the rivet 14 prior to punching. During punching, the upper plate 14 acts against the rivet 14. In other words, the rivet 14 acts as a support for the upper plate 4 during punching. When assembled, the substantially flat plate 20 abuts against the surface of the cover 26 facing the ring binder 2. This arrangement enhances the stability of the rivet 14, and thus the ring binder 2, relative to the cover 26.

FIGS. 5 and 6 show a second type of rivet 30 which may be used in the present invention. Similar to the rivet 14, the rivet 30 comprises a cylindrical body 32 having a narrower inwardly bent head 34 which is deformable, e.g. by punching, to engage the depression 12 of the curved upper plate 4. The rivet 30 also has a substantially flat plate 36 having four holes 38. Depending from the periphery of each hole 38 are a set of claws 40 which may be deformed, e.g. by pressing, to engage the cover 26. The claws 40 are pushed out from the substantially flat plate 36. The body 32, head 34, substantially flat plate 36 and claws 40 are all integrally formed, so as to enhance the strength of the rivet 30. The main different between the rivet 30 and the rivet 14 is that the rivet 30 comprises a shoulder portion 42 constituting a ledge on which the underside of the depression 12 of the curved upper plate 4 may sit. This enhances the punching action whereby the head 34 is secured to the depression 12, and the engagement therebetween.

As shown in FIG. 7, a second embodiment of a ring binder according to the present invention is generally designated as 102. As in the first embodiment 2 discussed above, this ring binder 102 comprises a substantially curved upper plate 104 supporting a pair of elongate plates 106*a* and 106*b* pivotally moveable relative to each other. Secured to the elongate plates 106*a* and 106*b* are three ring members 108. Engaged with an open depression (not shown) near each end of the curved upper plate 104 is a rivet 110, either of the type designated as 14, or the type designated as 30. As compared with the ring binder 2, the ring binder 102 does not include any lever which may be depressed outward to open the ring members 108. In this embodiment, the ring members 108 are opened or closed by being pulled apart or pushed together.

It should be noted that the above only describes examples whereby the present invention may be carried out, and it is possible to make further modifications or improvements to these examples while not departing from the spirit of the invention.

I claim:

1. A ring binder for securing to a base member, the ring binder comprising a substantially rigid upper structure supporting a pivotable lower structure;

a plurality of ring members mounted to said lower structure; and at least one securing means for securing said ring binder to a base member, each of said at least one securing means comprises a post member with an inwardly bent upper end for directly engaging said at least one securing means with said upper structure of said ring binder.

2. A ring binder according to claim 1 wherein said upper end is deformable to engage the upper structure.

3. A ring binder according to claim 2 wherein said post member is substantially upstanding.

4. A ring binder according to claim 2 or 3 wherein the upper structure comprises a recess with which said upper end is deformable to engage.

5. A ring binder according to claim 4 wherein said upper end comprises a ledge member for receiving at least part of an underside surface of the recess.

6. A ring binder according to claim 1 wherein each of said securing means comprises at least one securing member adapted to engage a base member.

7. A ring binder according to claim 6 wherein each of said at least one securing members comprises a plurality of securing elements each deformable to engage a base member.

8. A ring binder according to claim 1 wherein said upper structure of said ring binder comprises a recess; and said at least one securing means comprises at least one securing member for engaging a base member, and a post member with a deformable upper end for engaging said recess of said upper structure.

9. A ring binder according to claim 8 wherein said at least one securing member comprises a plurality of securing elements each deformable for engaging a base member; and each of said post members is integrally formed with its respective securing member.

10. A ring binder according to claim 6 or 9, wherein a post member of said at least one securing means is integrally formed with a securing member.

11. A ring binder according to claim 7 or 9 wherein said plurality of securing elements are substantially downwardly pointing.

12. A ring binder according to claim 11 wherein each of said plurality of securing elements comprises an arcuate sector.

13. A ring binder according to claim 12 wherein the plurality of securing elements depend downward from the periphery of an aperture on a plate member of the securing means.

14. A ring binder according to claim 13 wherein the plate member is adapted to abut against the base member.

* * * * *